US010184646B2

(12) United States Patent
Kijima et al.

(10) Patent No.: US 10,184,646 B2
(45) Date of Patent: Jan. 22, 2019

(54) LIGHTING DEVICE AND LIGHTING SYSTEM INCLUDING THE SAME

(71) Applicant: Almo Technos Co., Ltd., Ritto-shi, Shiga (JP)

(72) Inventors: Yasutaka Kijima, Ritto (JP); Tomihiko Sakaguchi, Ritto (JP)

(73) Assignee: ALMO TECHNOS CO., LTD., Ritto-shi (JP)

( * ) Notice: Subject to any disclaimer, the term of this patent is extended or adjusted under 35 U.S.C. 154(b) by 318 days.

(21) Appl. No.: 14/907,940

(22) PCT Filed: Jul. 13, 2015

(86) PCT No.: PCT/JP2015/070013
§ 371 (c)(1),
(2) Date: Jan. 27, 2016

(87) PCT Pub. No.: WO2016/009984
PCT Pub. Date: Jan. 21, 2016

(65) Prior Publication Data

US 2016/0169490 A1 Jun. 16, 2016

(30) Foreign Application Priority Data

Jul. 16, 2014 (JP) ..... 2014-145835

(51) Int. Cl.
*F21V 14/00* (2018.01)
*F21V 21/15* (2006.01)
(Continued)

(52) U.S. Cl.
CPC ..... *F21V 21/15* (2013.01); *F21S 8/026* (2013.01); *F21V 14/02* (2013.01); *F21V 15/01* (2013.01);
(Continued)

(58) Field of Classification Search
CPC .. F21S 8/02; F21S 8/026; F21V 14/02; F21V 14/06
See application file for complete search history.

(56) References Cited

U.S. PATENT DOCUMENTS 6,511,208 B1 * 1/2003 Kotovsky ..... F21S 8/02 362/147
6,837,596 B2 * 1/2005 Tanaka ..... F21S 10/007 362/277
(Continued)

FOREIGN PATENT DOCUMENTS

JP H06-96872 A 4/1994
JP H08-8067 A 1/1996
(Continued)

OTHER PUBLICATIONS

Sep. 8, 2015 International Search Report issued in International Patent Application No. PCT/JP2015/070013.
(Continued)

*Primary Examiner* — Zheng Song
(74) *Attorney, Agent, or Firm* — Oliff PLC

(57) ABSTRACT

A lighting device suitably adaptable to those that can adjust an irradiation angle stably. A lighting device includes a lighting device housing, a support housing supported by the lighting device housing so as to be freely rotatable about a first rotation axis, and a lighting unit supported by the support housing so as to be freely rotatable about a second rotation axis. The support housing is suspended from the lighting device housing, and is provided with a ring member protruding radially outward at its outer periphery. The lighting device housing is provided with a circular receiving part for supporting the ring member on the support housing side when the suspension is released.

5 Claims, 10 Drawing Sheets

(51) Int. Cl.

| | |
|---|---|
| *F21V 21/14* | (2006.01) |
| *F21V 15/01* | (2006.01) |
| *F21V 14/02* | (2006.01) |
| *F21V 19/02* | (2006.01) |
| *F21S 8/02* | (2006.01) |
| *F21Y 115/10* | (2016.01) |
| *F21Y 113/13* | (2016.01) |

(52) U.S. Cl.
CPC ..... *F21V 19/02* (2013.01); *F21V 21/14* (2013.01); *F21Y 2113/13* (2016.08); *F21Y 2115/10* (2016.08)

(56) References Cited

U.S. PATENT DOCUMENTS

| | | | | |
|---|---|---|---|---|
| 7,011,435 | B1 * | 3/2006 | Blaymore | F21V 21/15 362/371 |
| 7,618,166 | B1 * | 11/2009 | Truax | F21V 21/30 362/269 |
| 8,297,804 | B2 * | 10/2012 | Buse | F21V 21/04 362/147 |
| 8,829,778 | B2 | 9/2014 | Sakuta et al. | |
| 2005/0254233 | A1 * | 11/2005 | Alessio | F21L 4/00 362/169 |
| 2009/0268474 | A1 * | 10/2009 | Ward | F21S 8/02 362/364 |
| 2012/0112626 | A1 | 5/2012 | Sakuta et al. | |
| 2014/0185302 | A1 * | 7/2014 | Ebisawa | F21V 5/007 362/311.01 |
| 2014/0204574 | A1 * | 7/2014 | Ebisawa | F21S 8/026 362/235 |
| 2015/0276190 | A1 * | 10/2015 | Devlin | F21V 21/15 362/362 |

FOREIGN PATENT DOCUMENTS

| | | | |
|---|---|---|---|
| JP | 2000-082301 | A | 3/2000 |
| JP | 2004-342392 | A | 12/2004 |
| JP | 2005-268001 | A | 9/2005 |
| JP | 2006-286826 | A | 10/2006 |
| JP | 2011-176276 | A | 9/2011 |
| KR | 10-1190847 | B1 | 10/2012 |

OTHER PUBLICATIONS

Sep. 8, 2015 Written Opinion issued in International Patent Application No. PCT/JP2015/070013.
Jul. 13, 2016 Office Action issued in Japanese Patent Application No. 2014-145835.

* cited by examiner

LIGHTING DEVICE AND LIGHTING SYSTEM INCLUDING THE SAME

TECHNICAL FIELD

The present invention relates to a lighting device capable of adjusting a lighting direction and a lighting system including the same.

BACKGROUND

There have been proposed spotlights, as an example of lighting devices, including a ballast box and a lighting fixture attached to the ballast box (see Patent Document 1, for example). The lighting fixture of the spotlights includes a lighting main body with a lamp mounted on a socket of the lighting main body.

The lighting main body is attached to the ballast box in a manner described next. That is, a hollow turning arm is attached to an end of the ballast box so as to be freely rotatable about a vertical mounting screw (functioning as a vertical axis), and a hollow bush (functioning as a horizontal axis) is freely rotatably attached to a side surface of the lighting main body. The hollow bush is fit and fixed to the turning arm. Thus, the lighting main body can be turned about the vertical axis and rotated about the horizontal axis to adjust its irradiation angle.

RELATED ART

Patent Document 1: JP2000-82301

SUMMARY

Problems to be Solved by the Invention

However, because this type of spotlight (lighting device) has a configuration that turns the entire lighting main body and that turns about a side part of a shade of the lighting main body, it is difficult to stably rotate the same. It is also difficult to apply the same to those that automatically rotate. There has been a demand for a lighting device favorably applicable to those that can automatically and stably adjust a lighting angle.

Also, in lighting systems using this type of lighting device, changing color tones of illumination light from the lighting device according to a color of an object to be irradiated can improve displayed goods or the like in appearance. There is, however, nothing that can adjust a color tone. There has been a demand for a lighting system capable of changing color tones of an irradiation light.

It is an object of the invention to provide a lighting device applicable to ones that can adjust an irradiation angle stably.

It is another object of the invention to provide a lighting system that can adjust a color tone of an illumination light of a lighting device.

Means to Solve the Problems

The lighting device the invention is characterized by including a lighting device housing, a support housing supported by the lighting device housing so as to be freely rotatable about a first rotation axis extending in an up-down direction, and a lighting unit supported by the support housing so as to be freely rotatable about a second rotation axis extending in a lateral direction, wherein: the support housing is suspended from the lighting device housing and has an outer periphery provided with an outer protrusion protruding radially outward; the lighting device housing is formed with a circular receiving part at a position below the outer protrusion of the support housing; and when suspension of the support housing is released, the outer protrusion of the support housing is supported by the circular receiving part of the lighting device housing.

Also, the lighting device of the invention is characterized by: a first drive source for rotating the support housing about the first rotation axis being mounted on an upper wall of the lighting device housing; the first drive source being provided with a first gear; a support shaft being fixed to the upper wall of the support housing; the support shaft being suspended from the lighting device housing; and a second gear provided to the support shaft being drivingly connected to the first gear.

Also, the lighting device of the invention is characterized by: the outer protrusion of the support housing being formed of a ring member mounted on an outer periphery of the support housing; and the ring member of the support housing side being supported by the circular receiving part of the lighting device housing when the suspension of the support housing is released.

Also, the lighting device of the invention is characterized by the lighting unit including a unit housing mounted on the support housing so as to be freely rotatable about the second rotation axis, the unit housing being provided with a gear part, a second drive source for driving the lighting unit about the second rotation axis being mounted on the support housing side, a worm gear being drivingly connected to the second drive source, and the worm gear being drivingly connected to the gear part of the unit housing through a gear train.

Also, the lighting device the invention is characterized by: the lighting unit including a unit housing supported by the support housing, an irradiation substrate mounted on the unit housing, a plurality of LED elements mounted on the irradiation substrate, a circular moving member supported by the unit housing so as to be freely movable in a direction of the first rotation axis, and a light diffusion member mounted on the circular moving member for diffusing lights from the plurality of LED elements; a cam mechanism being formed between the unit housing and the circular moving member; and the cam mechanism moving the circular moving member in the direction of the first rotation axis relative to the unit housing.

A lighting device of the invention is characterized by including a lighting device housing, a support housing supported by the lighting device housing so as to be freely rotatable about a first rotation axis extending in an up-down direction, and a lighting unit supported by the support housing so as to be freely rotatable about a second rotation axis extending in a lateral direction, wherein: the lighting unit includes a unit housing mounted on the support housing so as to be freely rotatable about the second rotation axis; the unit housing is provided with a gear part; a drive source is mounted on the support housing side for rotating the lighting unit about the second rotation axis; a worm gear is drivingly connected to the drive source; and the worm gear is connected to the gear part of the unit housing through a gear train.

A lighting device of the invention is characterized by including a lighting device housing, a support housing supported by the lighting device housing so as to be freely rotatable about a first rotation axis extending in an up-down direction, and a lighting unit supported by the support housing so as to be freely rotatable about a second rotation axis extending in a lateral direction, wherein: the lighting unit includes a unit housing supported by the support housing, an irradiation substrate mounted on the unit housing, a plurality of LED elements mounted on the irradiation substrate, a circular moving member supported by the unit housing so as to be freely movable in a direction of the first rotation axis, and a light diffusion member mounted on the circular moving member for diffusing lights from the plurality of LED elements; a cam mechanism is formed between the unit housing and the circular moving member; and the cam mechanism moves the circular moving member in the direction of the first rotation axis relative to the unit housing.

The lighting device of the invention is characterized by that a circular rotating member is freely rotatably mounted on the unit housing; the cam mechanism includes a cam groove formed in the circular rotating member and a pin member attached to the circular moving member and received in the cam groove; and when the circular rotating member rotates, the pin member relatively moves along the cam groove, thereby moving the circular moving member in the direction of the first rotation axis relative to the unit housing.

A lighting system of the invention is characterized by including; a lighting device including a lighting device housing, a support housing supported by the lighting device housing so as to be freely rotatable about a first rotation axis extending in an up-down direction, and a lighting unit supported by the support housing so as to be freely rotatable about a second rotation axis extending in a lateral direction; and a controller that controls the lighting device, wherein: the lighting unit of the lighting device includes an irradiation substrate mounted on the support housing and a plurality of LED elements mounted on the irradiation substrate; the plurality of LED elements include a first LED chip that illuminates in a first color and a second LED chip that illuminates in a second color differing from the first color; the controller includes a first electric current control section for controlling an electric current supplied to the first LED chip of the lighting device and a second electric current control section for controlling an electric current supplied to the second LED chip of the lighting device; in order to adjust a color tone of the lighting device, the first electric current control section controls the electric current supplied to the first LED chips of the plurality of LED elements of the lighting device for adjusting brightness of light emitted therefrom, and the second electric current control section controls the electric current supplied to the second LED chips of the plurality of LED elements of the lighting device for adjusting brightness of light emitted therefrom.

The lighting system of the invention is characterized by that the controller is configured to control a plurality of lighting devices; in relation to this, the controller includes a grouping setting section for grouping in order to adjust the color tone of the plurality of lighting devices; in order to adjust the color tone of lighting devices of a specific group grouped by the grouping setting section, the first electric current control section controls the electric current supplied to the first LED chips of the plurality of LED elements of the lighting devices of the specific group to adjust brightness of lights emitted therefrom, and the second electric current control section controls the electric current supplied to the second LED chips of the plurality of LED elements of the lighting devices of the specific group to adjust brightness of lights emitted therefrom.

The lighting system of the invention is characterized by that the plurality of lighting devices includes a first driving source for rotating the support housing about the first rotation axis and a second driving source for rotating the lighting unit about the second rotation axis; the grouping setting section functions also as a setting section for grouping so as to adjust an irradiation angle of the plurality of lighting devices; and in order to adjust the irradiation angle of lighting devices of a second specific group set by the grouping setting section, the controller controls the first and second drive sources of the lighting devices of the second specific group to adjust the irradiation angle thereof.

Effects

According to the lighting device of the invention, the support housing is supported by the lighting device housing so as to be freely rotatable about the first rotation axis, and the lighting unit is supported by the support housing so as to be freely rotatable about the second rotation axis. Thus, it is possible to stably rotate the support housing (i.e., the lighting unit) about the first rotation axis and also to stably rotate the lighting unit about the second rotation axis. In this manner, the irradiation angle of the lighting device can be adjusted. Also, providing a drive source in relation to the support housing the lighting unit, for example, makes it possible to automatically rotate the support housing and the lighting unit.

Also, because the support housing is suspended from the lighting device housing, friction resistance of the support housing rotating about the first rotation axis can be made small, enabling to smoothly rotate the support housing with a relatively small rotation force.

Further, the outer protrusion protruding radially outward is formed on the outer periphery of the support housing, and the circular receiving part is provided below the outer protrusion of the support housing. Thus, even if the suspension of the support housing is released, the outer protrusion of the support housing is supported by the circular receiving part of the lighting device housing. In this manner, the support housing is reliably prevented from falling.

Also, according to the lighting device of the invention, the first drive source is mounted on the upper wall of the lighting device housing, and the support shaft is fixed to the upper wall of the support housing, and the support shaft is suspended from the lighting device housing. Thus, it is possible to hang the support housing from the lighting device housing. Also, the first gear is provided to the first drive source, and the second gear is provided to the support shaft, and the first gear and the second gear are drivingly connected to each other. Thus, it is possible to transmit the drive force from the first drive source to the support shaft so as to rotate the support housing (i.e., the lighting unit) about the first rotation axis as needed.

Also, according to the lighting device of the invention, the outer protrusion of the support housing is formed of the ring member mounted on the outer periphery of the support housing. Thus, even if the suspension of the support housing is released, the circular receiving part of the lighting device housing can further reliably support the ring member on the support housing side. Also, because the ring member is formed of synthetic resin, even if the ring member contacts the circular receiving part of the lighting device housing, contact resistance is suppressed small.

Also, according to the lighting device of the invention, the unit housing is mounted on the support housing so as to be freely rotatable about the second rotation axis, and the unit housing is provided with the gear part, and the worm gear drivingly connected to the second drive source is drivingly connected to the gear part through the gear train. Thus, it is possible to rotate the unit housing about the second rotation axis as needed by the second drive source. In addition, because the worm gear is used, rotational resistance of the worm gear prevents the unit housing from rotating due to its own weight (and members mounted thereon).

Also, according to the lighting device of the invention, the lighting unit includes the unit housing supported by the support housing, the circular moving member supported by the unit housing so as to be freely movable in the direction of the first rotation axis, and the light diffusion member mounted on the circular moving member, and the cam mechanism is formed between the unit housing and the circular moving member. Thus, it is possible to move the circular moving member in the direction of the first rotation axis relative to the unit housing with using the cam mechanism. This enables to diffuse and condense light from the plurality of LED elements.

Also, according to the lighting device of the invention, the cam mechanism includes the cam groove formed in the circular rotating member on the unit housing side and the pin member attached to the circular moving member, and the pin member is received in the cam groove. Thus, when the circular rotating member rotates, the pin member relatively moves along the cam groove, moving the circular moving member (i.e., the light diffusion member) relative to the unit housing in the direction of the first rotation axis (i.e., in the direction closer to and farther from the plurality of LED elements).

Also, according to the lighting system of the invention, the lighting unit of the lighting device includes the plurality of LED elements mounted on the irradiation substrate, and the plurality of LED elements include the first LED chip that illuminates in the first color and the second LED chip that illuminates in the second color. Thus, it is possible to change the color tone of light emitted from the LED element by adjusting light emitting state of the two types of LED chips. Also, the first electric current control section controls the electric current supplied to the first LED chips of the plurality of LED elements so as to adjust brightness of lights emitted therefrom, and the second electric current control section controls the electric current supplied to the second LED chips of the plurality of LED elements so as to adjust brightness of lights emitted therefrom. Thus, it is possible to adjust the color tone of the entire lighting unit as needed.

Also, according to the lighting system of the invention, the controller includes the grouping setting section for grouping the plurality of lighting devices. Thus, with regard to the lighting devices of the first specific group grouped by the grouping setting section, the color tone of the lighting devices of the specific group can be adjusted by the first electric current control section controlling the electric current supplied to the first LED chips of the LED elements thereof and the second electric current control section controlling the electric current supplied to the second LED chips of the LED elements thereof.

Further, according to the lighting system of the invention, the grouping setting section also functions for grouping in order to adjust the irradiation angle of the lighting devices. With regard to the lighting devices of the second specific group grouped by the grouping setting section, the irradiation angle of the lighting devices of the second specific group can be adjusted by the controller controlling the first and second drive sources thereof.

DETAILED DESCRIPTION

A lighting device according to the invention and a lighting system including the same will be described while referring to the accompanying drawings.

[Embodiment of Lighting Device]

Figure 1:
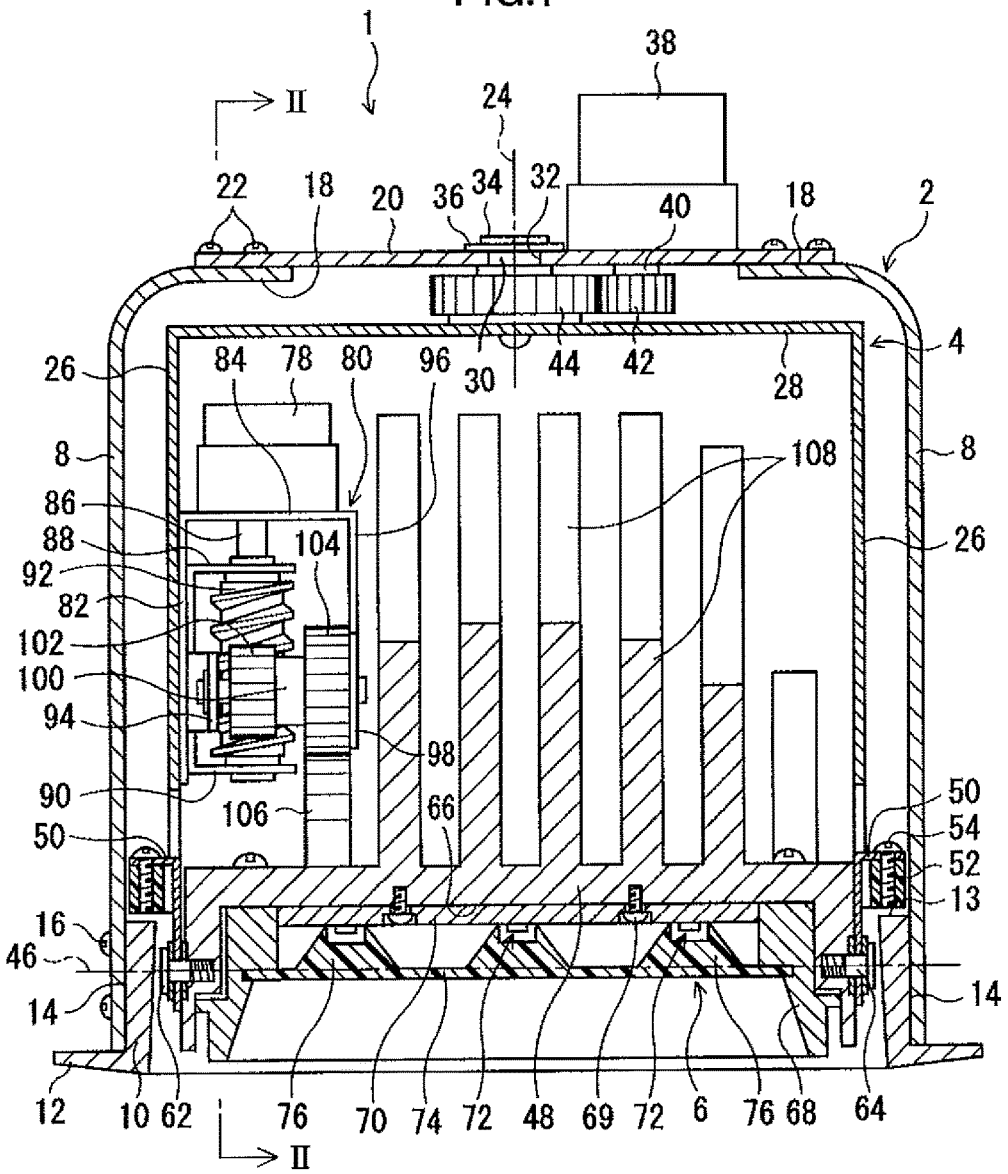
FIG. 1 A cross-sectional view of an embodiment of a lighting device according to the invention.
Figure 2:
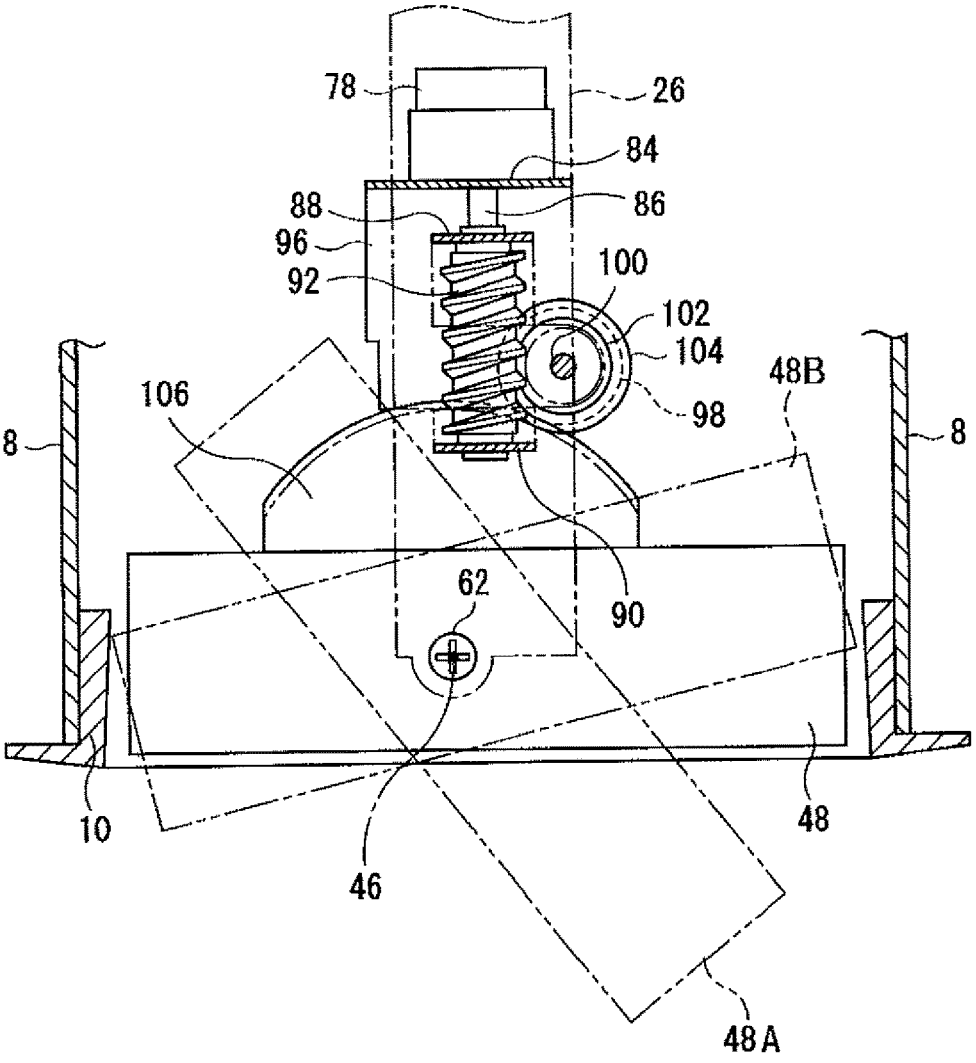
FIG. 2 A cross-sectional view taken along a II-II line in FIG. 1

First, an embodiment of a lighting device will be described with reference to FIGS. 1 and 2. In FIGS. 1 and 2, a lighting device 1 shown in the drawings includes a lighting device housing 2 to be attached to a ceiling of a room or the like, and a support housing 4 and a lighting unit 6 are mounted on the lighting device housing 2. The lighting device housing 2 shown in the drawings includes four columnar frames 8 (only two of them are shown in FIGS. 1 and 2) disposed at even intervals along a circumferential direction and a circular opening member 10 disposed at an opening of the lighting device housing 2. A circular flange 12 is provided at an opening end of the circular opening member 10 to protrude radially outward. A circular upper surface of the circular opening member 10 functions as a circular receiving part 13 as will be understood from the description below.

The circular opening member 10 is provided with planner attaching parts 14 at even intervals in the circumferential direction, and each columnar frame 8 is disposed on the corresponding attaching part 14. The columnar frame 8 is fixed by a fixing screw 16 at its lower part so that its lower end abuts the circular flange 12. An upper part 18 of each columnar frame 8 is bent to the radial direction, and an upper wall 20 is attached between the bent upper parts 18 by set screws 22.

The support housing 4 is supported by the lighting device housing 2 so as to be freely rotatable about a first rotation axis 24 extending in an up-down direction. The support housing 4 shown in the drawings is formed substantially in the shape of letter U, and has a pair of side wall parts 26 and an upper wall part 28 connecting upper ends of the pair of side wall parts 26. The upper wall part 28 is freely rotatably supported. In the embodiment shown in the drawings, a support shaft 30 (functioning as the first rotation axis 24) is fixed to the upper wall part 28 of the support housing 4 by, for example, caulking. On the other hand, the upper wall 20 of the lighting device housing 2 is formed with an opening 32. The support shaft 30 of the support housing 4 side protrudes upward through the opening 32, and a locking member 36 (snap ring, for example) is engaged with this protruding end part 34. With this configuration, the support housing 4 is supported by the upper wall 20 of the lighting device housing 2, hanged by the locking member 36.

A first drive motor 38 (configuring a first drive source) for rotating the support housing 4 is provided on the lighting device housing 2 side. In this embodiment, the first drive motor 38 is attached to the upper wall 20 of the lighting device housing 2, and an output shaft 40 of the first drive motor 38 extends through an opening (not shown) of the upper wall 20 to the support housing 4 side. A first gear 42 is attached to the output shaft 40. Also, a second gear 44 is attached to a support shaft 34 fixed to the support housing 4. The first gear 42 is engaged with the second gear 44. Thus, a rotation force from the first drive motor 38 is transmitted via the first gear 42 and the second gear 44 to the support shaft 34 and rotates the support housing 4 integrally with the support shaft 34 about the first rotation axis 24. Note that the second gear 44 may be formed integrally with the support shaft 34 by resin mold.

The lighting unit 6 is supported by the support housing 4 so as to be freely rotatable about a second rotation axis 46 extending in a lateral direction (a right-left direction in FIG. 1, a direction perpendicular to a sheet surface of FIG. 2). The lighting unit 6 shown in the drawings includes a round unit housing 48. The unit housing 48 is freely rotatably supported between lower ends of the pair of side wall parts 26 of the support housing 4. One of the side wall parts 26 is located outward of one side of the unit housing 48, and the unit housing 48 is freely rotatably mounted on the one of the side wall parts 26 by screwing a support screw 62 to the unit housing 48 through the side wall part 26 (see FIG. 2). Also, the other of the side wall parts 26 is located outward of the other side of the unit housing 48, and the unit housing 48 is freely rotatably mounted on the other of the side wall parts 26 by screwing a support screw 64 to the unit housing 48 through the side wall part 26. With this configuration, the unit housing 48 can rotate between a position indicated by a two-dotted chain line 48*a* in FIG. 2 (that is, a position where a light emitting surface to be described later faces diagonally downward and leftward in FIG. 2) and a position indicated by a two-dotted chain line 48*b* in FIG. 2 (that is, a position where the light emitting surface faces diagonally downward and right in FIG. 2) about the pair of support screws 62 and 64 (the support screws 62 and 64 function as the second rotation axis 46).

In this embodiment, each of the pair of wall parts 26 is formed with a attachment protrusion 50 by its portion bent outward. The ring member 52 is attached to the attachment protrusion 50 by a set screw 54. The ring member 52 is preferably formed of synthetic resin (for example, polyoxymethylene (POM)). The ring member 52 functions as an outer protrusion of the support housing 4. The ring member 52 is located above and slightly separated from the circular receiving part 13 of the lighting device housing 2 side. In the event that the locking member 36 is unlocked, the ring member 52 of the support housing 4 side falls and supported on the circular receiving part 13 of the lighting device housing 2 side, preventing the support housing 4 (and those mounted thereon) from falling on a floor or the like. Note that the outer protrusion of the support housing 4 side supported by the circular receiving part 13 is not necessarily formed circular, but may be formed at intervals in the circumferential direction.

The unit housing 48 is formed with a round groove 66 formed in its nearly entire lower surface (a lower surface in FIG. 1). A tubular reflection member 68 is mounted on an outer periphery of the round groove 66. Also, an irradiation substrate 70 is attached to a bottom of the round groove 66 located radially inward of the tubular reflection member 68 by a screw 69. The irradiation substrate 70 is mounted with a plurality of LED elements 72. A light diffusion member 74 is mounted on the tubular reflection member 68 so as to cover the plurality of LED elements 72. The light diffusion member 74 includes light diffusion parts 76 covering each LED element 72. With this configuration, lights from the plurality of LED elements 72 are diffused by the light diffusion member 74 (especially by the light diffusion parts 76), and irradiated from the light emitting surface, that is, the opening side of the unit housing 48, through the light diffusion member 74.

A second drive motor 78 (configuring a second drive source) for rotating the unit housing 48 (and the plurality of LED elements 72 and the like mounted thereon) is provided on the support housing 4 side. In this embodiment, a substantially-U-shaped support frame 80 is disposed inward of one of the side wall parts 26 (the side wall part 26 on the left side in FIG. 1) of the support housing 4, and a side wall part 82 of the support frame 80 is attached to an inner surface of the one of the side wall parts 26. An upper wall part 84 of the support frame 80 is attached with the second drive motor 78. An output shaft 86 of the second drive motor 78 protrudes inward (that is, downward in FIG. 1) through an opening (not shown) of the upper wall part 84.

In this embodiment, substantially-L-shaped support members 88, 90 are mounted on an inner surface of the side wall part 82 of the support frame 80 at an interval in the up-down direction. A worm gear 92 (so-called worm) is freely rotatably supported between the support members 88, 90. The worm gear 92 is drivingly connected to the output shaft 86 of the second drive motor 78. Also, the side wall part 82 is formed, by bent, with a bent auxiliary wall part 94. The other side wall part 96 of the support frame 80 is provided with an auxiliary wall part 98. A support shaft 100 is freely rotatably supported between the bent auxiliary wall part 94 and the auxiliary wall part 98. A first transmission gear 102 (so-called, worm wheel) is mounted on one end side of the support shaft 100 (a left end side in FIG. 1), and the first transmission gear 102 is engaged with the worm gear 92. A second transmission gear 104 is mounted on the other end side of the support shaft 100 (a right end side in FIG. 1). These first and second transmission gears 102, 104 rotate integrally with the support shaft 100 and configure a gear train for transmitting a drive force from the second drive motor 78. Note that the support shaft 100, the first transmission gear 102, and the second transmission gear 104 may be integrally formed of synthetic resin.

In this embodiment, a gear part 106 is provided on a rear surface (an upper surface in FIGS. 1 and 2) of the unit housing 48. The gear part 106 is engaged with the second transmission gear 104. Also, a plurality of heat sink members 108 is provided on the rear surface of the unit housing 48 at intervals in an axis direction of the second rotation axis 46. These heat sink members 108 protrude upwards.

With this configuration, the rotation force from the second drive motor 78 is transmitted through the worm gear 92, the first transmission gear 102, and the second transmission gear 104 to the gear part 106 of the unit housing 48, and the unit housing 48 (that is, the lighting unit 6) is rotated by the gear part 106 about the second rotation axis 46.

Figure 3:
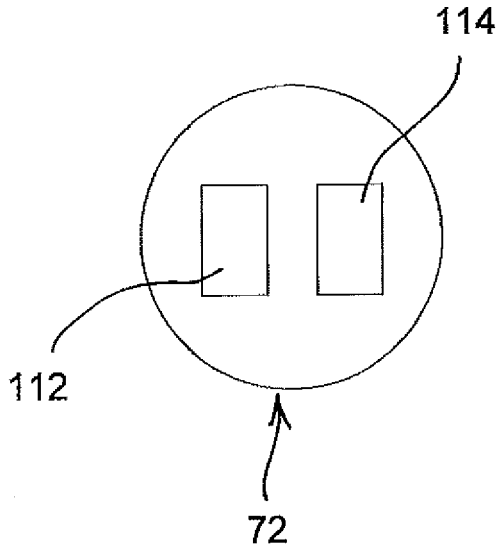
FIG. 3 A front view of one of a plurality of LED elements of the lighting device of FIG. 1

In this embodiment, each of the plurality of LED elements 72 of the lighting unit 6 is configured as shown in FIG. 3. That is, the LED element 72 is formed by combining two LED chips, that is, a first LED chip 112 and a second LED chip 114. The first LED chip 112 emits light in a first color (for example, flesh color), and the second LED chip 114 emits light in a second color (for example, white color) different from the first color. Using a combination of the first and second LED chips 112 and 114 that emit lights in different colors makes the LED element 72 emit light in a color resultant from a combination of the first color and the second color.

It is possible to adjust the color tone of light emitted from the LED element 72 by using the combination of two different types of LED chips, that is, the first and second LED chips 112, 114, as the LED element 72 and by changing light emitting states thereof.

Figure 4:
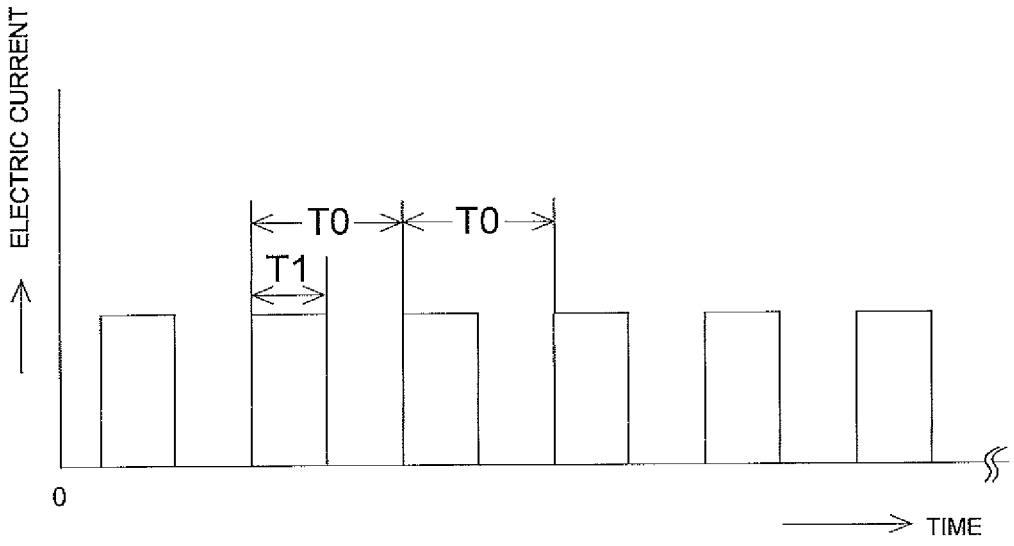
FIG. 4 A view showing an example of electric currents supplied to an LED chip of the LED element of FIG. 3
Figure 5:
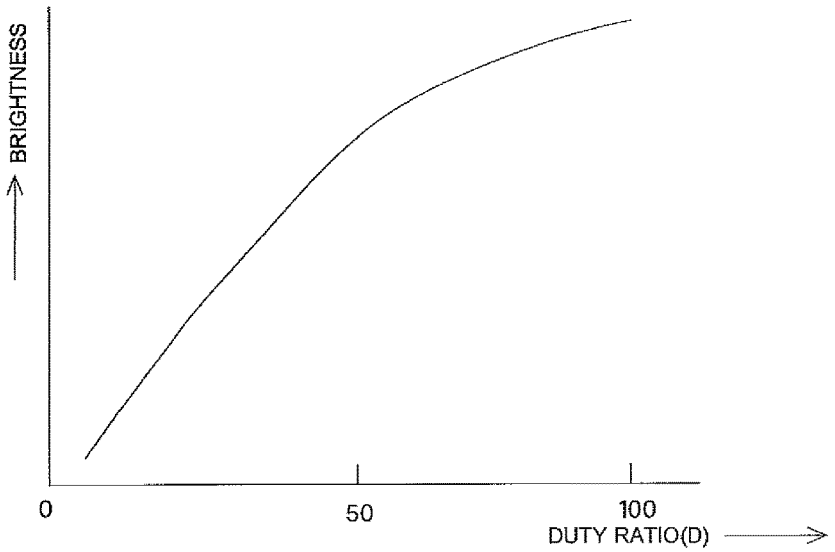
FIG. 5 A view showing a relationship between duty ratio of the electric current supplied to the LED element and brightness of emitted light FIG. 6(*a*) is a view showing a relationship between a position of a color-tone adjustment lever and brightness of a first LED chip and a second LED chip of the LED element, and FIG. 6(*b*) is a view explaining operation on the color-tone adjustment lever.

In this embodiment, electric currents supplied to the first and second LED chips 112, 114 of the LED elements 72 are duty-controlled as shown in FIG. 4. A duty ratio D (%) is expressed as D=(T1/T0)×100(%); wherein T0 is a time duration of one current supply cycle, and T1 is a time duration where an electric current is supplied in the cycle time duration T0. When the duty ratio D is set larger, then the current supply time duration T1 in the cycle time duration T0 becomes longer. FIG. 5 shows relationship between the duty ratios D of electric currents supplied to the first and second LED chips 112, 114 and brightness of lights emitted therefrom. As the duty ratios D of electric currents supplied to the first and second LED chips 112, 114, the brightness of emitted lights increases.

Figure 6:
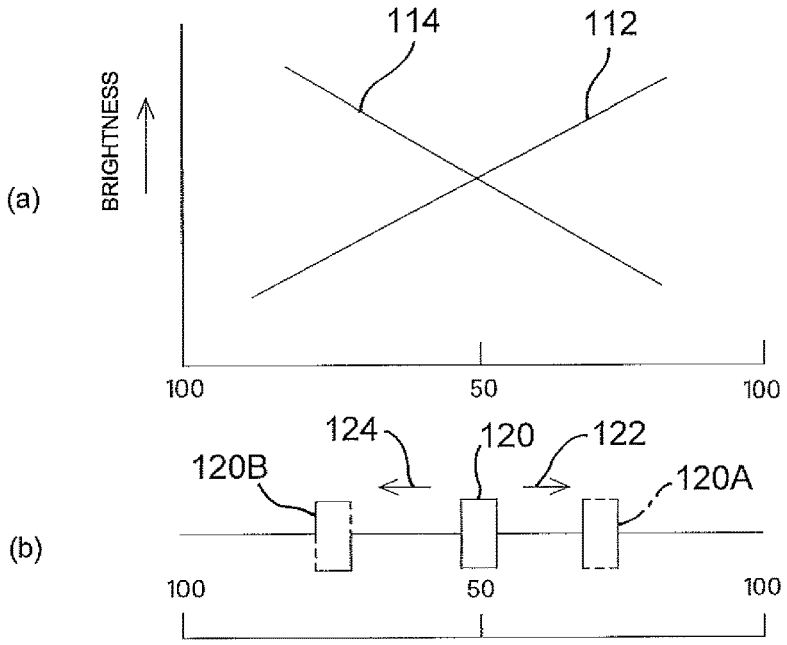

Using the relationships, the color tone of emitted light from the LED element 72 is adjusted as described next. In this embodiment, there is provided a color tone adjustment lever 120 for adjusting color tone of light emitted from the LED element 72 as described later. The color tone adjustment lever 120 is formed to be operated to slide as shown in FIG. 6(*b*). In FIG. 6(*b*), when the color tone adjustment lever 120 is located in the center (indicated with "50"), the duty ratio D of the electric current supplied to the first LED chip 112 is 50%, and the duty ratio D of the electric current supplied to the second LED chip 114 is 50%. Thus, as shown in FIG. 6(*a*), the brightness of the light from the first LED chip 112 is the same as the brightness of the light from the second LED chip 114, and the LED element 72 emits light in a color resultant from combining the luminous color (for example, fresh color) of the first LED chip 112 and the luminous color (for example, white color) of the second LED chip 114 in substantially the same brightness.

When the color tone adjustment lever 120 is moved rightward as indicated by an arrow 122 to a position indicated by a single-dot-chain line 120A in FIG. 6(*b*), for example, then the duty ratio D of the electric current supplied to the first LED chip 112 becomes more than 50%, and the duty ratio D of the electric current supplied to the second LED chip 114 becomes less than 50%. Thus, as shown in FIG. 6(*a*), the light from the first LED chip 112 becomes brighter, and the light from the second LED chip 114 becomes darker. The LED element 72 emits light in a color resultant from combining the brighter luminous color of the first LED chip 112 and the darker luminous color of the second LED chip 114, that is, in a color with more fresh color.

Also, when the color tone adjustment lever 120 is moved leftward as indicated by an arrow 124 to a position indicated by a single-dot-chain line 120B in FIG. 6(*b*), for example, then the duty ratio D of the electric current supplied to the first LED chip 112 becomes less than 50%, and the duty ratio D of the electric current supplied to the second LED chip 114 becomes more than 50%. Thus, as shown in FIG. 6(*a*), the light from the first LED chip 112 becomes darker, and the light from the second LED chip 114 becomes brighter. The LED element 72 emits light in a color resultant from combining the darker luminous color of the first LED chip 112 and the brighter luminous color of the second LED chip 114, that is, in a color with more white color.

In this manner, the tone of the luminous color from the LED element 72 can be adjusted by operating the color tone adjustment lever 120 to change the duty ratios D of the electric currents supplied to the first and second LED chips 112, 114

[Embodiment of Lighting System]

Figure 7:
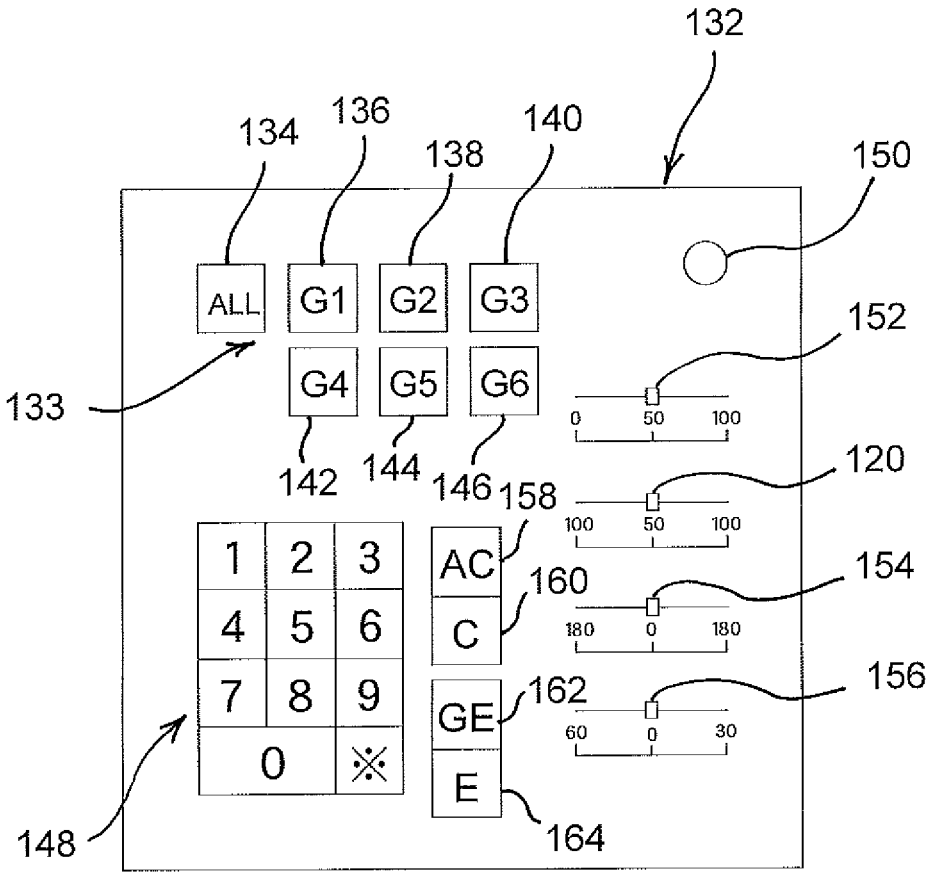
FIG. 7 A view showing an example of an operation device of a lighting system according to the invention FIG. 8 A simplified block diagram of a control system controlled by the operation device of FIG. 7
Figure 8:
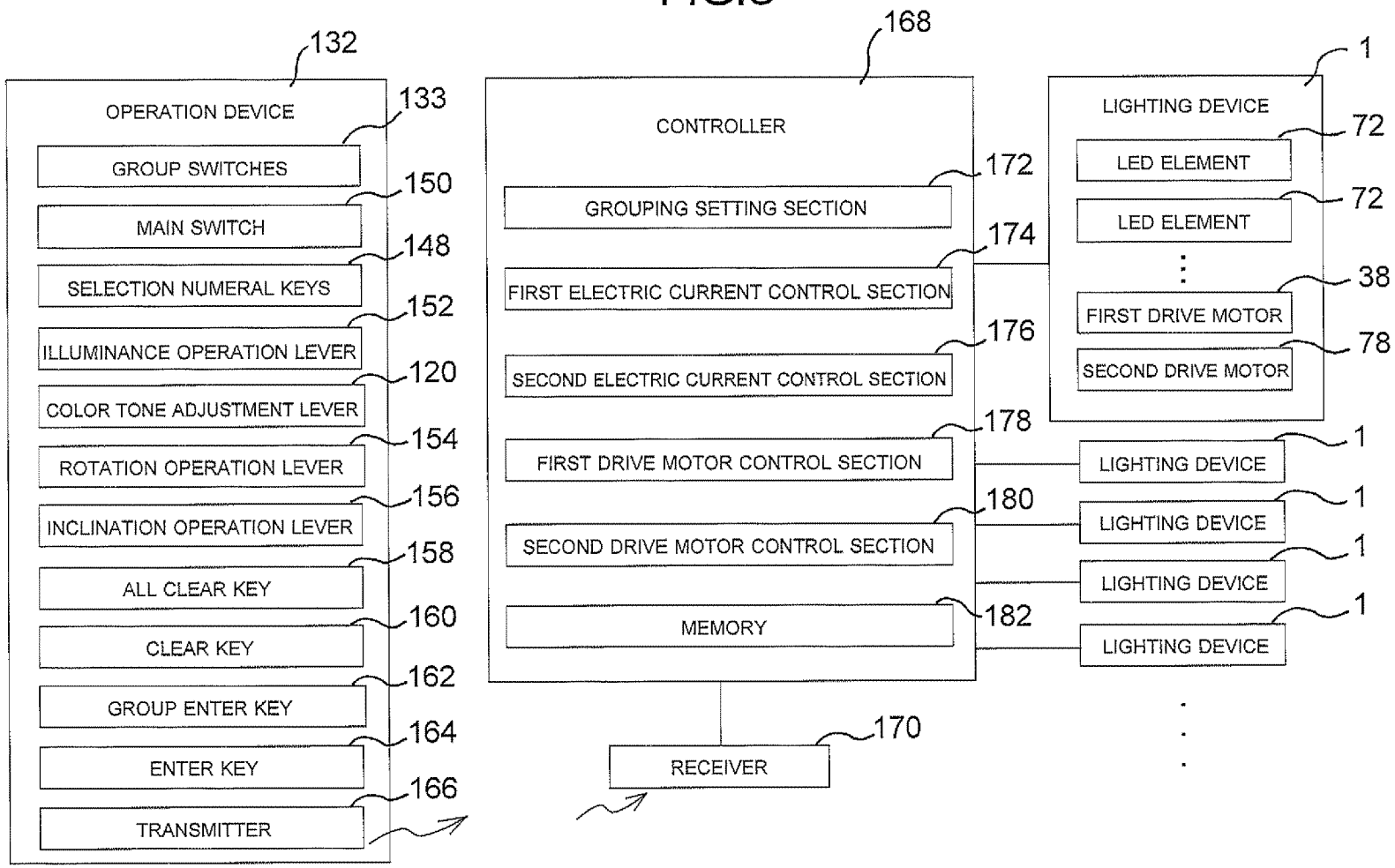

A lighting system with the above-described lighting device installed on a ceiling of a hall or the like can adjust the tone of the luminous color, an irradiation angle, and the like with a control system described next, for example. With reference to FIGS. 7 and 8, in this lighting system, operation control is performed with an operation device 132 shown in FIG. 7. In FIG. 7, group switches 133 are disposed at an upper left section of the operation device 132. The group switches 133 include switches 134, 136, 138, 140, 142, 144, 146. The switch 134 is an all switch. When the all switch 134 is operated, then all of the lighting devices 1 installed on the celling of the hall or the like are selected. Also, the switch 136 (138, 140, 142, 144, 146) is for selecting the lighting device(s) 1 grouped in a manner described later. When the first group switch 136 (the second group switch 138, the third group switch 140, the fourth group switch 142, the fifth group switch 144, the sixth group switch 146) is operated, then one or more of the plurality of lighting devices 1 grouped as a first group (a second group, a third group, a fourth group, a fifth group, a sixth group).

Selection numeral keys 148 for the lighting devices 1 are disposed at a lower left section of the operation device 132. Each of the plurality of lighting devices 1 is allocated with individual ID number, e.g. "01," "02," "03," . . . . When "01" ("02," "03," . . . ) is input with the selection numeral keys 148, then the lighting device 1 with the ID number "01" ("02," "03," . . . ) is selected.

Also, a main switch 150 is disposed at an upper right section of the operation device 132. When the main switch 150 is operated, then the power of the operation device 132 is turned ON, enabling operation on the operation device 132. When the main switch 150 is operated again, then the power of the operation device 132 is turned OFF.

An illuminance operation lever 152, the color tone adjustment lever 120, a rotation operation lever 154, and an inclination operation lever 156 are disposed in this order from the top at a right section of the operation device 132. The illuminance operation lever 152 is for adjusting illumination of the plurality of LED elements 72 (the first LED chips 112 and the second LED chips 114) of the lighting device 1. When the illuminance operation lever 152 is operated rightward (or leftward), then the duty ratio D of the electric current supplied to the plurality of LED elements 72 (the first LED chips 112 and the second LED chips 114) becomes larger (or smaller), increasing (or decreasing) the illuminance of the LED elements 72. Note that the operation on the color tone adjustment lever 120 is as described above.

The rotation operation lever 154 is for rotating the lighting unit 6 of the lighting device 1. When the rotation operation lever 154 is operated rightward (or leftward), for example, then the first drive motor 38 of the lighting device 1 rotates in a predetermined direction (or a direction opposite from the predetermined direction), thereby rotating the support housing 4 (and the lighting unit 6 and the like mounted thereon) in a clockwise direction (or a counter-clockwise direction) when viewed from the above in FIG. 1, for example, about the first rotation axis 24.

Further, the inclination operation lever 156 is for inclining the lighting unit 6 of the lighting device 1. When the inclination operation lever 156 is operated rightward (or leftward), for example, then the second drive motor 78 of the lighting device 1 rotates in a predetermined direction (or a direction opposite from the predetermined direction), thereby rotating the lighting unit 6 in the counter clockwise direction (or clockwise direction) in FIG. 2 about the second rotation axis 46.

The operation device 132 also includes an all clear key 158, a clear key 160, a group enter key 162, and an enter key 164. The all clear key 158 is for clearing entire group information on grouped lighting devices 1. The clear key 160 is for clearing selected group information. The group enter key 162 is for grouping selected lighting device(s) 1. The enter key 164 is for input a selected lighting device(s) 1. The operation device 132 includes a transmitter 166. Operation information on the operation device 132 is transmitted through the transmitter 166 to a controller 168 (functioning as a control section for performing overall control) of the lighting system.

A receiver 170 is provided in relation to the controller 168. Operation signals from the transmitter 166 on the operation device 132 side is sent to the controller 168 through the receiver 170. Note that the operation signals may be sent through a cable like a communication line.

The controller 168 shown in the drawing includes a grouping setting section 172, a first electric current control section 174, a second electric current control section 176, a first drive motor control section 178, a second drive motor control section 180, and a memory 182. The grouping setting section 172 is for setting grouping of the plurality of lighting devices 1. For example, a selection group is set when the group enter key 162 of the operation device 132 is operated and then the group switch 133 is pressed. For example, when the switch 134 (136, 138, . . . ) is operated, then the first group (the second group, the third group . . . ) is selected. After the group is selecting in this manner, the ID number(s) of the lighting device(s) 1 is input to group the lighting device(s) 1. For example, after the switch 134 (136, 138 . . . ) is operated, "0," "1," and "#" of the selection numeral keys 148 are pressed in this order. As a result, the ID number "01" of the lighting device 1 is input to the first group (the second group, the third group . . . ). When "0," "3," and "#" of the selection numeral keys 148 are subsequently pressed in this order, then the ID number "03" of the lighting device 1 is input to the first group (the second group, the third group . . . ). The ID numbers input in this manner are sent to the controller 168 side and registered as those belongs to the first group (the second group, the third group) in the memory 182. In this embodiment, as will be understood from FIG. 7, up to six groups can be set. However, the number of the groups may be set less or greater than that. One of the first to sixth groups set in this manner will be described as a first specific group in this specification, and one of these will be described as a second specific group in this specification. The first specific group and the second specific group may be either the same group or different groups.

Also, the first electric current control section 174 controls the electric current supplied to the first LED chips 112 of many LED elements 72 of the lighting device 1, and the second electric current control section 176 controls the electric current supplied to the second LED chips 114 of the LED elements 72. Also, the first drive motor control section 178 controls the first drive motor 38 of the lighting device 1, and the second drive motor control section 180 controls the second drive motor 78 of the lighting device 1.

For example, in order to adjust the color tone of the light emitted from a plurality of lighting devices 1 grouped as the first group (the second group, the third group . . . ) (this group will be referred to as the lighting devices 1 of the first specific group), a user operates the switch 136 (138, 140 . . . ) of the operation device 132 to select the first group (the second group, the third group . . . ), and then operates the color tone adjustment lever 120 and inputs the group enter key 162. With this operation, a setting position information of the color tone adjustment lever 120 is sent to the controller 168 side and registered in the memory 182 as a color tone information of the lighting devices 1 of the first specific group.

Then, the electric current supplied to the plurality of LED elements 72 of the lighting devices 1 of the first specific group is controlled based on the color tone information registered in the memory 182. That is, the first electric current control section 174 of the controller 168 controls the electric current supplied to the first LED chips 112 of the plurality of LED elements 72 of the lighting devices 1 of the first specific group, and the second electric current control section 176 thereof controls the electric current supplied to the second LED chips 114 of the plurality of LED elements 72 of the lighting devices 1 of the first specific group. As a result, the light emitting state of the plurality of LED elements 72 of the lighting devices 1 of the first specific group changes, adjusting the color tone of the light emitted from the lighting devices 1.

Also, in order to adjust the irradiation angle of the plurality of lighting devices 1 grouped as the first group (the second group, the third group . . . ) (this group will be referred to as the lighting devices 1 of the second specific group), for example, a user operates the switch 136 (138, 140 . . . ) of the operation device 132 to select the first group (the second group, the third group . . . ), and then operates the rotation operation lever 154 and/or the inclination operation lever 156 and inputs the group enter key 162. With this operation, a setting position information of the rotation operation lever 154 and/or the inclination operation lever 156 is sent to the controller 168 side and registered in the memory 182 as an irradiation angle information of the lighting devices 1 of the second specific group.

As a result, an irradiation angle position of the lighting units 6 of the lighting devices 1 of the second specific group is adjusted based on the irradiation angle information registered in the memory 182. For example, when the rotation operation lever 154 is operated, then the first drive motor control section 178 of the controller 168 controls the first drive motors 38 of the lighting devices 1 of the second specific group. As a result, the support housings 4 (and the lighting units 6 mounted thereon) of the lighting devices 1 of the second specific group rotate about the first rotation axis 24, adjusting rotation positions of the lighting devices 1.

Also, when the inclination operation lever 156 is operated, for example, then the second drive motor control section 180 of the controller 168 controls the second drive motors 78 of the lighting devices 1 of the second specific group. As a result, the lighting units 6 of the lighting devices 1 of the second specific group rotate about the second rotation axis 46, adjusting an inclination angle position of the lighting devices 1.

Note that, when both of the rotation operation lever 154 and the inclination operation lever 156 are operated, then as will be understood from the above description, the first drive motor control section 178 controls the first drive motors 38 of the lighting devices 1 of the second specific group, and also the second drive motor control section 180 controls the second drive motors 78 of the lighting devices 1 of the second specific group. Thus, the rotation position and the inclination angle of the lighting devices 1 of the second specific group are adjusted.

[Different Embodiment of Lighting Device]

Figure 9:
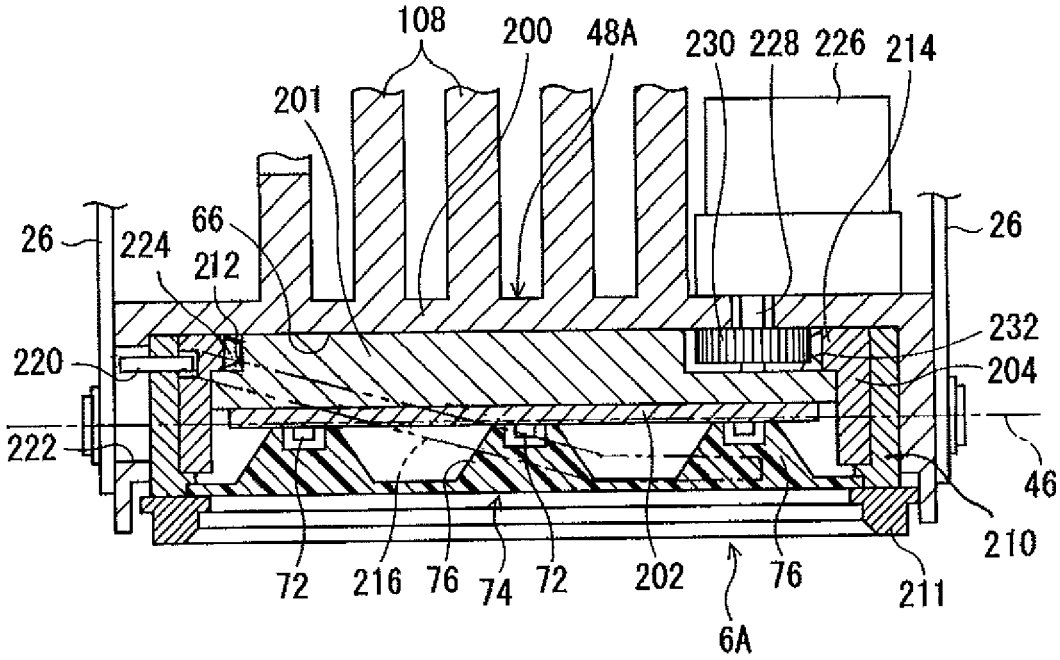
FIG. 9 A cross-sectional view of significant parts of a different embodiment of a lighting device according to the invention FIG. 10 A perspective view of a circular rotating member of the lighting device of FIG. 9
Figure 10:
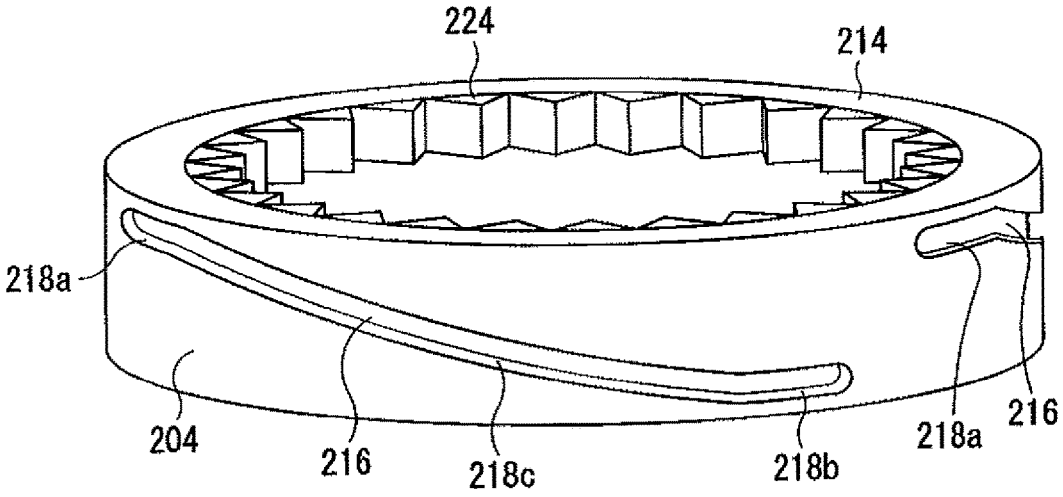
Figure 11:
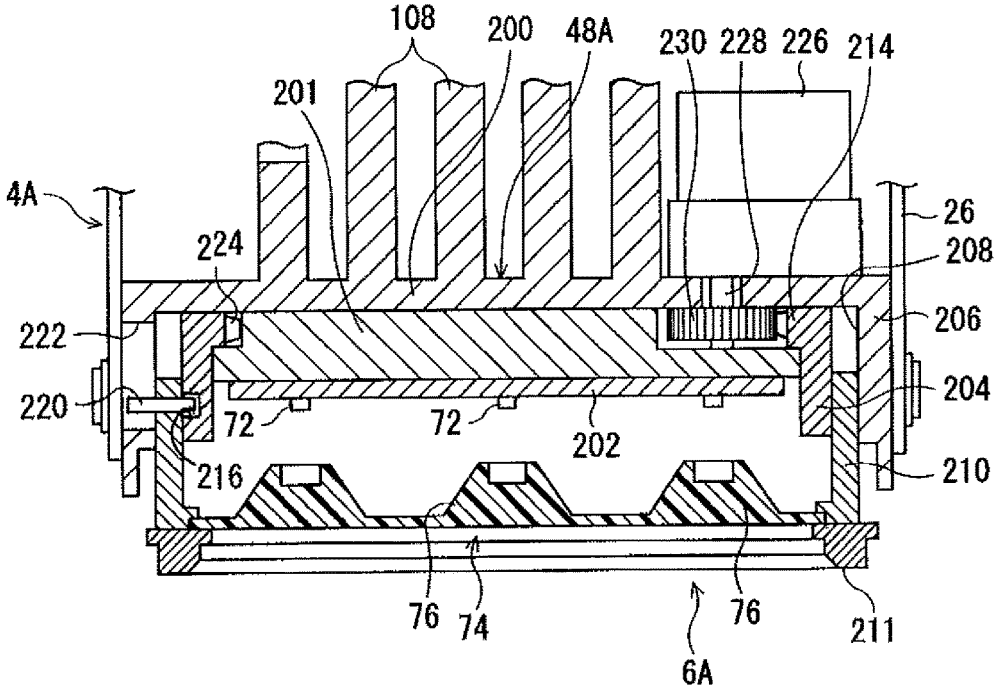
FIG. 11 A cross-sectional view showing a light diffusion member of the lighting device of FIG. 9 positioned away from the plurality of LED elements

The lighting device may be configured as shown in FIGS. 9 to 11, for example. In this different embodiment, a light diffusion member is configured movable closer to and farther from a plurality of LED elements. Note that, in this embodiment, parts that are substantially the same as those of the above embodiment (see FIGS. 1 and 2) will be assigned with the same references, and description thereof will be omitted.

In FIGS. 9 and 10, in this embodiment, a lighting unit 6A is supported by the support housing 4 so as to be freely rotatable about the second rotation axis 46 extending in the lateral direction (right-left direction in FIG. 9). The lighting unit 6A shown in the drawing includes a unit housing 48A. The unit housing 48A is supported between the lower ends of the pair of side wall parts 26 of the support housing 4 in the same manner as described above.

The unit housing 48A of this embodiment includes a unit housing main body 200 with the round groove 66 formed in its nearly entire lower surface (a lower surface in FIG. 9) and a substantially short-columnar block member 201 attached to a center section of the round groove 66. An irradiation substrate 202 is attached to the lower surface of the block member 201. The plurality of LED elements 72 are mounted on the irradiation substrate 202. Further, the light diffusion member 74 is disposed to cover the plurality of LED elements 72. As will be described later, the light diffusion member 74 is configured movable between a first position shown in FIG. 9 (a proximity position close to the irradiation substrate 202) and a second position shown in FIG. 11 (a separated position separated from the irradiation substrate 202).

The light diffusion member 74 includes the light diffusion parts 76 corresponding to each LED element 72. When the light diffusion member 74 is at the first position, then each light diffusion part 76 covers the corresponding LED element 72 as shown in FIG. 9. In this condition, lights from the plurality of LED elements 72 are focused, and the irradiation light from the lighting device is focused and condensed. Also, when the light diffusion member 74 is at the second position, each light diffusion part 76 is located away from the corresponding LED element 72. In this condition, the lights from the plurality of LED elements 72 are diffused around, so the irradiation right from the lighting device diffuses around.

A circular rotating member 204 is freely rotatably mounted on the unit housing 48A. A circular space 208 is defined between the circular rotating member 204 and a peripheral wall part 206 of the unit housing main body 200. A circular moving member 210 is fit inside the circular space 208 so as to be freely movable in the direction of the first rotation axis (see FIG. 1). A circular attaching member 211 is attached to a tip end of the circular moving member 210. A periphery of the light diffusion member 74 is sandwiched between the circular moving member 210 and the circular attaching member 211. The light diffusion member 74 moves integrally with the circular moving member 210.

In this embodiment, a circular groove 212 is formed at a periphery of an inner surface (an upper surface in FIG. 9) of the block member 201 of the unit housing 48A, and a circular support flange 214 is formed at an end (an upper end in FIG. 9) of the circular rotating member 204 so as to protrude radially inward. The circular support flange 214 is freely rotatably engaged with the circular groove 212. In this manner, the circular rotating member 204 is freely rotatably supported by the unit housing 48A.

As shown in FIG. 9, a pair of cam grooves 216 is formed in an outer peripheral surface of the circular rotating member 204. These cam grooves 216 are formed to confront each other. The pair of cam grooves 216 has substantially the same configuration, and has an upper horizontal part 218*a* extending in the horizontal direction at an upper position of the circular rotating member 204, a lower horizontal part 218*b* extending in the horizontal direction at its lower position, and an inclined part 218*c* connecting the upper horizontal part 218*a* and the lower horizontal part 218*b*. Note that three or more cam grooves 216 may be formed in the outer peripheral surface of the circular rotating member 204.

In relation to this, in this embodiment, pin members 220 (only one of them are shown in FIGS. 9 to 11) are fixed to the upper section of the circular moving member 210 in correspondence with each cam groove 216. One end of the pin member 220 is received in the corresponding cam groove 216 on the circular rotating member 204 side and is configured freely movable along the cam groove 216. The cam grooves 216 and the pin members 220 configure a cam mechanism for rotating the circular rotating member 204. Also, the other end of the pin member 220 is inserted in an elongated through hole 222 (only one is shown in FIGS. 9 to 11) formed in the peripheral wall part 206 of the unit housing main body 200. The elongated through hole 222 extends in the direction of the first rotation axis (see FIG. 1). Inserting the pin members 220 into the elongated through holes 222 enables the pin members 220 to move in the direction of the first rotation axis along the elongated through holes 222. However, the pin members 220 do not rotate relative to the unit housing main body 200 (i.e., the unit housing 48A). Thus, the circular moving member 210 is prevented from rotating relative to the unit housing 48A.

More specifically, an inner gear part 224 is formed in nearly entire inner periphery of the circular support flange 214 of the circular rotating member 204. Also, a third drove motor 226 (configuring a third drive motor) for rotating the circular rotating member 204 is mounted on a predetermined position of the unit housing main body 200 of the unit housing 48A, and its output shaft 228 penetrates through the unit housing main body 200 and is freely rotatably supported by the block member 201. A drive gear 230 attached to the output shaft 228 is engaged with the inner gear part 224 on the circular rotating member 204 side. Note that the block member 201 is formed with a receiving groove 232 in correspondence with the drive gear 230. The drive gear 230 is received in the receiving groove 232. The rest of the configuration of the lighting device of this embodiment is substantially the same as that of the above-described lighting device (see FIGS. 1 and 2).

In this lighting device, when the third drove motor 226 rotates in a predetermined direction (a direction opposite from the predetermined direction), then the circular rotating member 204 is rotated in a predetermined direction (or a direction opposite from the predetermined direction) through the drive gear 230 and the inner gear part 224. As a result, the pin members 220 move along the cam grooves 216 toward the upper horizontal part 218*a* (or the lower horizontal part 218*b*) as the circular rotating member 204 rotates. This movement of the pin members 220 moves the circular moving member 210 upward (or downward) toward (or away from) the unit housing main body 200 along the first rotation axis. At this time, the pin members 220 move upward (or downward) within the elongated through holes 222 of the unit housing main body 200.

When the circular moving member 210 moves in this manner, then the light diffusion member 74 move integrally therewith toward (or away from) the plurality of LED elements 72, and the lights from the plurality of LED elements 72 are focused (or diffused). In this manner, the irradiation light from the lighting device is condensed (or diffused around).

When the third drove motor 226 rotates further in the predetermined direction (or the direction opposite from the predetermined direction), then the pin members 220 move to the upper horizontal parts 218*a* (or the lower horizontal parts 218*b*) of the cam grooves 216, and the circular moving member 210 moves to an upper position (or a lower position) as shown in FIG. 9 (or FIG. 11). The light diffusion member 74 is located at the first position (or the second position), and the light diffusion parts 76 cover the corresponding LED elements 72 (or are positioned largely away from the corresponding LED elements 72).

This lighting device also may be applied to the above-described lighting system. In this case, a focus/diffusion operation lever may be provided to a remote control device so that the light diffusion member 74 can be positioned at a desired position by moving the circular moving member 210 about the first rotation axis as described above in accordance with a position of the focus/diffusion operation lever. With this configuration, focus/diffusion state of the irradiation light of the lighting device may be automatically adjusted in addition to the rotation angle position and the inclination angle position.

While the lighting device and the lighting system of the invention have been described in detail with reference to the embodiments thereof, the invention is not limited to these embodiments, and various changes and modifications may be made therein without departing from the spirit of the invention.

For example, in the above-described embodiments, the plurality of LED elements 72 of the lighting device 1 are formed of two types of LED chips with different illumination colors, e.g., the first LED chip 112 and the second LED chip 114. However, they may be configured of three or more types of LED chips. When the LED element is configured of three types of LED chips, for example, the controller 168 may include a third electric current control section in addition to the first and second electric current control sections 174, 176 so that the first electric current control section 174 controls the electric current supplied to the first LED chip 112, and the second electric current control section 176 controls the electric current supplied to the second LED chip 114, and the third electric current control section (not shown in the drawings) controls the electric current supplied to a third LED element (not shown in the drawings).

EXPLANATION OF REFERENCE NUMBERS

1 lighting device
2 lighting device housing
4, 4A support housing
6, 6A lighting unit
13 circular receiving part
24 first rotation axis
38 first drive motor (first drive source)
46 second rotation axis
48, 48A unit housing
52 ring member
72 LED element
78 second drive motor (second drive source)
92 worm gear
112 first LED chip
114 second LED chip
120 color tone adjustment lever
132 operation device
154 rotation operation lever
156 inclination operation lever
168 controller
172 grouping setting section
174 first electric current control section
176 second electric current control section
178 first drive motor control section
180 second drive motor control section
204 circular rotating member
210 circular moving member
216 cam groove
220 pin member
226 third drive motor (third drive source)

What is claimed is:

1. A lighting device comprising:

a lighting device housing;

a support housing supported by the lighting device housing so as to be freely rotatable about a first rotation axis extending in an up-down direction; and a lighting unit supported by the support housing so as to be freely rotatable about a second rotation axis extending in a lateral direction, the lighting unit including:

a unit housing supported by the support housing and having a peripheral wall formed with an elongated through hole extending in the direction of the first rotation axis;

an irradiation substrate mounted on the unit housing;

a plurality of LED elements mounted on the irradiation substrate;

a circular rotating member freely rotatably mounted on the unit housing;

a circular moving member supported by the unit housing so as to be freely movable in a direction of the first rotation axis; and a light diffuser mounted on the circular moving member for diffusing lights from the plurality of LED elements, wherein:

a cam mechanism is formed between the unit housing and the circular moving member, the cam mechanism including:

a cam groove formed in the circular rotating member, and a pin member attached to the circular moving member and having one end extending into the elongated through hole and another end received in the cam groove, the cam mechanism moves the circular moving member in the direction of the first rotation axis relative to the unit housing without rotating the circular moving member relative to the unit housing, and when the circular rotating member rotates relative to the unit housing, then the pin member moves in the direction of the first rotation axis along the cam groove without rotating relative to the unit housing, thereby moving the circular moving member in the direction of the first rotation axis relative to the unit housing.

2. A lighting system comprising:

a plurality of the lighting device according to claim 1;

a controller that controls the plurality of lighting devices, the controller including a grouping setter for setting groups of the plurality of lighting devices; and an operation device, wherein:

the operation device includes a color tone adjustment lever and a switch for selecting one of the groups set by the group setter; and when the color tone adjustment lever is operated after one of the groups is selected by operation on the switch, the controller adjusts color tone of light emitted from the plurality of LED elements of the lighting devices of the selected one of the groups according to a position of the color tone adjustment lever.

3. The lighting system according to claim 2, wherein:

each of the lighting device further includes a first drive source for rotating the support housing about the first rotation axis and a second drive source for rotating the lighting unit about the second rotation axis;

the operation device also includes a rotation operation lever and an inclination operation lever;

when the rotation operation lever is operated after one of the groups is selected through operation on the switch, the controller controls the first drive sources of the lighting devices of the selected group to rotate the support housings of the lighting devices of the selected group based on a position of the rotation operation lever; and when the inclination operation lever is operated after one of the groups is selected through operation on the switch, the controller controls the second drive sources of the lighting devices of the selected group to rotate the lighting units of the lighting device of the selected group based on a position of the inclination operation lever.

4. The lighting system according to claim 2, wherein:

each of the LED elements includes a first LED chip that illuminates in a first color and a second LED chip that illuminates in a second color; and the controller controls color tone of light emitted from the lighting device by adjusting brightness of light emitted from the first LED chip by controlling an electric current supplied to the first LED chip and brightness of light emitted from the second LED chip by controlling an electric current supplied to the second LED chip.

5. The lighting device according to claim 1, further comprising:

a drive gear; and a motor that drives the drive gear to rotate, wherein:

the circular rotating member has an inner peripheral surface formed with an inner gear engaged with the drive gear, and when the motor drives the drive gear to rotate, then the circular rotating member rotates relative to the unit housing.

* * * * *